US006024407A

United States Patent [19]

Eakin

[11] Patent Number: 6,024,407

[45] Date of Patent: Feb. 15, 2000

[54] VIBRATING PARTICLE MATERIAL FILLED FURNITURE

[75] Inventor: Byron C. Eakin, Tampa, Fla.

[73] Assignee: Somatron Corporation, Tampa, Fla.

[21] Appl. No.: 09/058,602

[22] Filed: Apr. 10, 1998

[51] Int. Cl.[7] ..... A47C 7/62

[52] U.S. Cl. ..... 297/217.4; 297/452.17; 601/47; 601/49; 5/904; 5/911; 5/915; 5/702

[58] Field of Search ..... 297/217.3, 452.17, 297/217.4, 217.5, 452.41; 601/47, 57, 78, 46, 48, 49, 58, 59; 5/702, 911, 904, 915

[56] References Cited

U.S. PATENT DOCUMENTS

| | | | |
|---|---|---|---|
| 3,075,101 | 1/1963 | Neff | 601/78 X |
| 3,893,731 | 7/1975 | Maggs | 297/452.17 |
| 3,899,210 | 8/1975 | Samhammer et al. | 297/452.17 X |
| 4,005,703 | 2/1977 | Rosen et al. | 601/57 |
| 4,011,611 | 3/1977 | Lederman | 297/452.17 X |
| 4,027,888 | 6/1977 | Wilcox | 297/452.17 |
| 4,326,506 | 4/1982 | Kawabata | 601/57 |
| 4,718,876 | 1/1988 | Lee | 601/78 X |
| 4,750,208 | 6/1988 | Yamada et al. | 601/47 X |
| 4,835,802 | 6/1989 | Purcey et al. | 5/904 X |
| 5,022,384 | 6/1991 | Freels et al. | 601/57 |
| 5,035,235 | 7/1991 | Chesky | 601/47 |
| 5,056,506 | 10/1991 | Verduci | 601/46 |
| 5,086,755 | 2/1992 | Schmid-Eilber | 601/47 |
| 5,097,821 | 3/1992 | Eakin | 601/47 |
| 5,101,810 | 4/1992 | Skille et al. | 601/47 |
| 5,143,055 | 9/1992 | Eakin | 601/47 |
| 5,314,403 | 5/1994 | Shaw | 601/57 X |
| 5,387,026 | 2/1995 | Matsuhashi et al. | 297/217.4 |
| 5,807,287 | 9/1998 | Cheng | 601/57 X |
| 5,857,985 | 1/1999 | Feng | 601/47 |

FOREIGN PATENT DOCUMENTS

| | | | |
|---|---|---|---|
| 525648 | 2/1993 | European Pat. Off. | 601/59 |
| 3633092 | 1/1988 | Germany | 601/57 |
| 1732988 | 5/1992 | U.S.S.R. | 601/46 |
| 86003109 | 6/1986 | WIPO | 601/57 |

*Primary Examiner*—Peter M. Cuomo
*Assistant Examiner*—David E. Allred

[57] ABSTRACT

Vibrating particle material filled furniture to allow for vibration of the furniture for the benefit and enjoyment of a user is disclosed. Various types of furniture may be utilized under the present invention. These include chairs, loungers, mattresses and pillows. Various types of materials, both natural and manufactured, may be used as the particle material. Various methods of producing the desired vibration are disclosed with examples given. These include those which rely upon manipulation of a magnetic field as well as mechanical devices. The resultant vibration may have a constant cycle rate or, more preferred, may be variable. A particularly desirable vibration method is disclosed which provides for the vibration to be synchronized with a musical composition. Such vibration in synch to the musical composition may be generated with or without audio production of the musical composition.

10 Claims, 5 Drawing Sheets

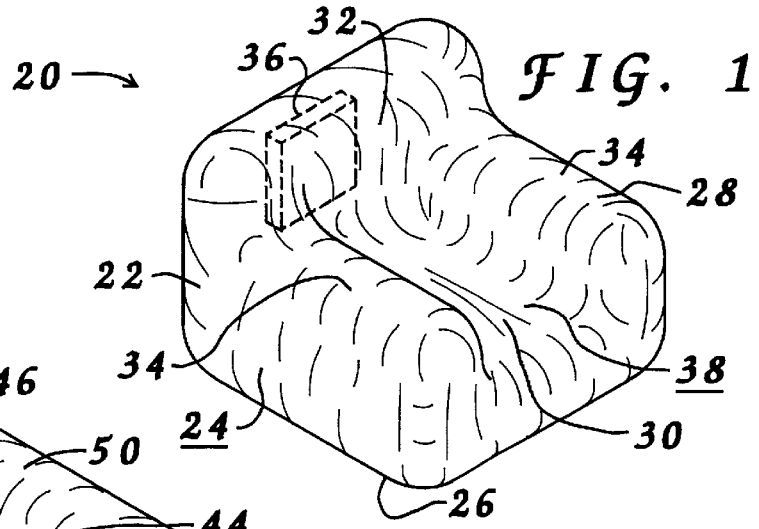
FIG. 1
FIG. 2
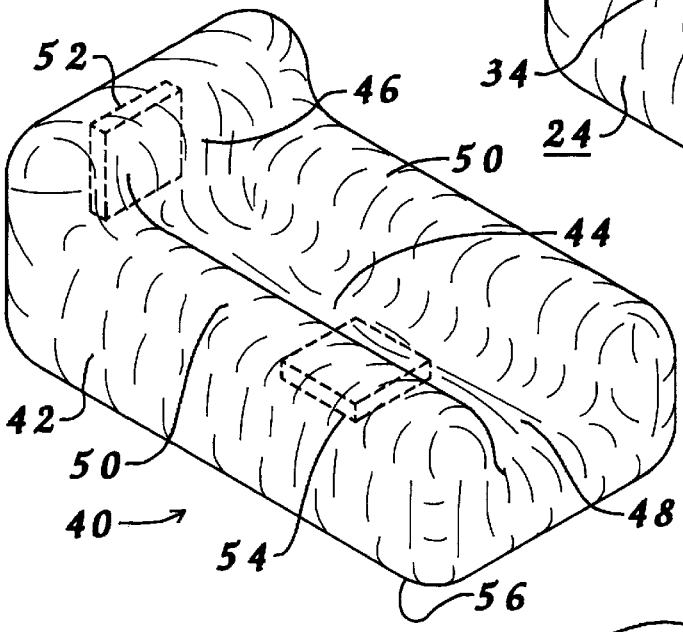
FIG. 5
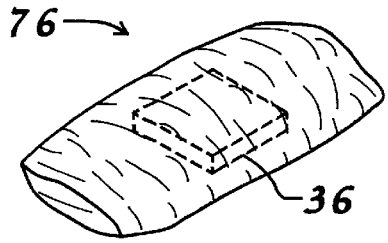
FIG. 3
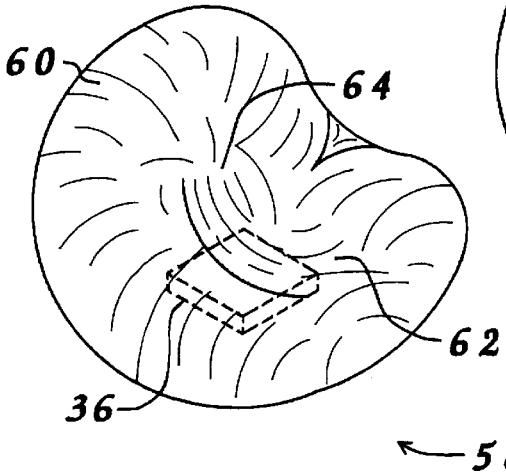
FIG. 4
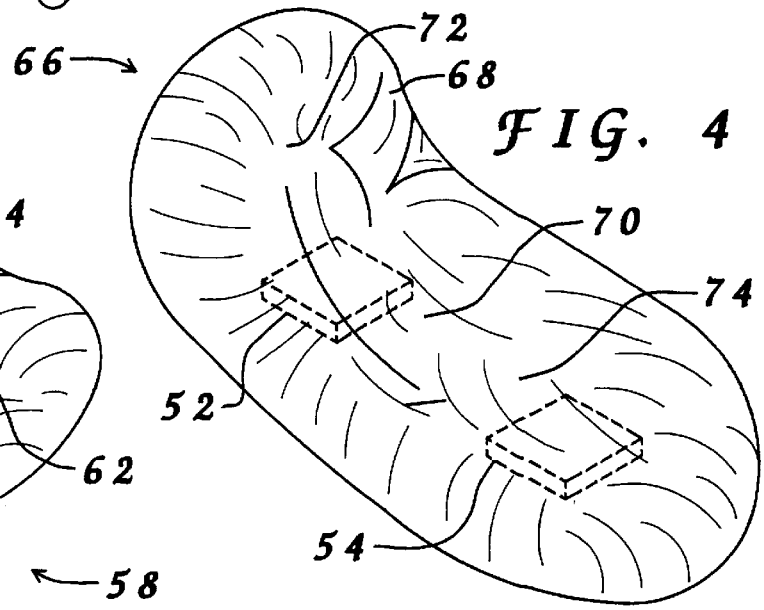

VIBRATING PARTICLE MATERIAL FILLED FURNITURE

BACKGROUND

1. Field of the Invention

Generally, the invention relates to vibrating furniture. More specifically, the invention relates to such vibrating furniture wherein a major aspect of construction thereof resides in a containment of particle material.

2. Description of the Prior Art

Various furniture constructed of a flexible enclosure filled with fluent particle material are known in the art. These are generally referred to as bean bag furniture. It is known to construct chairs, loungers and beds utilizing such constructions.

Various furniture constructed wherein vibration is imparted to a user resting on the furniture are known in the art. It is known to construct chairs, loungers and beds utilizing such constructions.

Various furniture constructed wherein audible reception of musical compositions may be appreciated by a user resting on the furniture are known in the art. It is known to construct chairs, loungers and beds utilizing such constructions.

Your applicant is unaware of the use of furniture constructed of flexible enclosures filled with particle material wherein vibration is imparted to the user resting on the furniture. Your applicant also is unaware of the use of furniture constructed of flexible enclosures filled with particle material wherein audible reception of musical compositions may be appreciated by a user resting on the furniture.

Various attempts have been made to provide for a vibratory experience wherein the user has a comfortable resting surface. These attempts have been less efficient than desired. Typically, these attempts have relied upon large sections of compressible material, such as foam rubber, contained within a cushions having a clearly definable shape. As such, it may be appreciated that there continues to be a need for a truly pliant resting surface which affords excellent contour conforming properties while allowing the fullest dispersal of the vibration being produced. The present invention substantially fulfills these needs.

SUMMARY

In view of the foregoing disadvantages inherent in the known types of vibrating furniture, your applicant has devised a method of providing for a vibrating particle material filled resting support furniture piece. The vibrating particle material filled resting support furniture piece has a particle material filled resting support, vibration means and control means. The particle material filled resting support is formed into an enclosure from a supple material. The enclosure has a quantity of loose material inserted therein to loosely fill the enclosure. Sealing means provide for sealing the closure with the loose material enclosed therein. The vibration means provides for a vibration of the loose material within the enclosure which causes an overall vibration of the particle material filled resting support. The control means provides for a selective activation and a selective deactivation of the overall vibration of the particle material filled resting support caused by the vibration of the loose material caused by the vibration means.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide for a vibration of a particle material filled support assembly.

Other objects include;

a) to provide for a comfortable support assembly which conforms to a user resting thereon.

b) to provide for the vibration wherein the support assembly further comprises a seating device.

c) to provide for the vibration wherein the support assembly further comprises a reclining device.

d) to provide for the vibration wherein the support assembly further comprises a seating area sized for convenient usage by a single user.

e) to provide for the vibration wherein the support assembly further comprises a seating area sized for convenient usage by a plurality of users.

f) to provide for the vibration to be a rhythmic vibration in synch with a musical composition.

g) to provide for an audio reproduction of the musical composition to accompany the rhythmic vibration in synch with the musical composition.

h) to provide for the particle material to be rigid particles.

i) to provide for the particle material to be deformable particles.

j) to provide for the particle material to be compressible particles.

k) to provide for a vibration generation device to be positioned in close proximity to a ground contacting surface of the support assembly.

l) to provide for a vibration generation device to be positioned substantially above the ground contacting surface of the support assembly.

m) to provide for the vibration to be created by a speaker.

n) to provide for the vibration to be created by a transducer.

o) to provide for the vibration to be created by a mechanical vibration device.

p) to provide for the vibrating support assembly to have any desired shape including those which will provide enjoyment to children as exampled by bunnies, puppies or kittens.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein;

FIG. 1 is a perspective view of a vibrating particle material filled seating device.

FIG. 2 is a perspective view of a vibrating particle material filled reclining device.

FIG. 3 is a perspective view of a second embodiment of a vibrating particle material filled seating device.

FIG. 4 is a perspective view of a second embodiment of a vibrating particle material filled reclining device.

FIG. 5 is a perspective view of a vibrating particle material filled pillow.

DESCRIPTION

Figure 6:
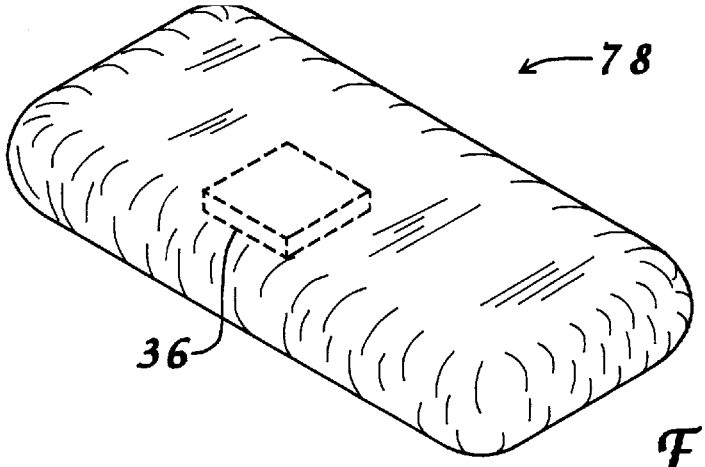
FIG. 6 is a perspective view of a vibrating particle material filled mattress.

Referring now to the drawings where like reference numerals refer to like parts throughout the various views. Various types of furniture may be employed utilizing the principles of the present invention. Examples of the types of furniture include single user seating assemblies, multiple user seating assemblies, single user reclining assemblies, multiple user reclining assemblies, single user lying assemblies, multiple user lying assemblies and pillows.

A user, or users, not shown in any of the various views, may be at least partially supported by any select embodiment of vibrating particle material filled furniture having features of the present invention. As conventionally known, such user may have a torso region, having a back area, a seat area and legs, having feet.

Furniture applicable to the present invention will be at least partially formed of a supple material to form an enclosure. While many embodiments of vibrating furniture may be constructed wherein the enclosure forms a single compartment, enclosures having multiple compartments are possible. It is preferred for many configurations of vibrating furniture that multiple compartments exist, perhaps with differing compression characteristics. The enclosure may have access means to allow for entry to an interior of the compartment or compartments. Such access means may be selected from any such means conventionally known in the art, as exampled by a zippered entry slot. The enclosure may be completely formed of the supple material or may have at least a portion thereof formed by a suitable rigid material, as exampled by plywood. Such rigid material may form a support contacting surface which may rest upon a floor or a secondary support frame. The enclosure may be formed by any of the methods conventionally known in the art, as exampled by stitching. The supple material may be any suitable material, as exampled by a fabric or a plastic. In the case of a plastic, heat bonding of seams is an applicable forming means. The enclosure, or enclosures, will be filled with a quantity of a particle material wherein outer surfaces of the enclosure may be deformed in response to pressures applied thereon dependent in part to movement of the particle material contained therein. Therefore, the applicable furniture pieces each will have a form which may be altered within predetermined limits dependent upon various factors, including the type and quantity of particle material utilized, the flexibility of the supple material and the construction of the enclosure.

While the embodiments depicted in the various views resemble conventional furniture pieces, other shapes are possible. One example of other shapes involves furniture for children having the shape of animals as exampled by bunnies, puppies or kittens. Other shapes applicable to children may involve shapes which resemble objects conventionally known to children during play. Other examples exist for shapes which would be desirable for adults.

FIG. 1 depicts a vibrating particle material filled seating device 20 as may be used to transfer vibration to a single user while the user is in a seated position. Vibrating particle material filled seating device 20 is substantially formed of a supple material 22. Vibrating particle material filled seating device 20 has a general form which is so formed as to retain its general form during usage. Vibrating particle material filled seating device 20 is formed into an enclosure 24. A ground contacting surface 26 may be formed of supple material 22 or a suitable rigid material. Therefore, enclosure 24 is a closed package.

Vibrating particle material filled seating device 20 has a deployed orientation 28 wherein ground contacting surface 26 rests upon a ground as exampled by a floor. While in deployed orientation 28 a seating surface 30 and a back support surface 32 provide for at least partial support of the user while resting upon vibrating particle material filled seating device 20 while the user's feet may rest upon the floor. Back support surface 32 extends substantially above seating surface 30 while in deployed orientation 28. Vibrating particle material filled seating device 20 has opposing arm rests 34 situated on opposing sides of seating surface 30 and elevated above seating surface 30.

A vibration creation device 36, as more fully disclosed elsewhere herein, will be in contact with vibrating particle material filled seating device 20, or a portion thereof. In the deployment depicted for FIG. 1, vibration creation device 36 is positioned in close proximity to back support surface 32 substantially above ground contacting surface 26. This contact may be from attachment thereto, as exampled by to supple material 22, or by placement within closure 24. Attachment of vibration creation device 36 to vibrating particle material filled seating device 20 may be to an exterior surface 38 thereof or, more preferred, to an interior surface, not shown, thereof.

As more fully disclosed elsewhere herein, vibration creation device 36 will cause a vibration of the particle material contained within a respective vibrating particle material filled furniture device to cause a general vibration thereabout. It is a desire to prevent migration of vibration creation device 36 through the particle material, and specifically to prevent such migration which would bring vibration creation device 36 into contact with a surface of the vibrating particle material filled furniture device which contacts the user during normal usage. Attachment of vibration creation device 36 to supple material 22 while inside of the respective vibrating particle material filled furniture device may act to prevent such migration of vibration creation device 36 through the particle material contained therein. Other migration prevention means may be provided as exampled by containment of a portion of the particle material around vibration creation device 36 as further exampled by a net bag, not shown.

FIG. 2 depicts a vibrating particle material filled reclining device 40 as may be used to transfer vibration to a single user while the user is in a reclined position. Vibrating particle material filled reclining device 40 has a general form which is so formed as to retain its general form during usage. Vibrating particle material filled reclining device 40 has a deployed orientation 42. While in deployed orientation 42 a seating surface 44, a back support surface 46 and a leg support surface 48 provide for at least partial support of the user while resting upon vibrating particle material filled reclining device 40 while the user's feet may be supported above the floor. Back support surface 46 extends substantially above seating surface 44 while in deployed orientation 42. Vibrating particle material filled reclining device 40 has opposing arm rests 50 situated on opposing sides of seating surface 44 and elevated above seating surface 44. A first vibration creation device 52 and a second vibration creation device 54 will be in contact with vibrating particle material filled reclining device 40 or a portion thereof. In the deployment depicted for FIG. 2, first vibration creation device 52 is positioned in close proximity to back support surface 46 substantially above a ground contacting surface 56 while second vibration creation device 54 is positioned in close proximity to ground contacting surface 56.

FIG. 3 depicts a vibrating particle material filled seating device 58 as may be used to transfer vibration to a single user while the user is in a seated position. Vibrating particle material filled seating device 58 has a general form which has smooth contours which change during usage. Vibrating particle material filled seating device 58 has a deployed orientation 60. While in deployed orientation 60 a seating surface 62 and a back support surface 64 provide for at least partial support of the user while resting upon vibrating particle material filled seating device 58 while the user's feet may rest upon the floor. Back support surface 64 extends substantially above seating surface 62 while in deployed orientation 60. Vibration creation device 36 provides for vibration of vibrating particle material filled seating device 58.

FIG. 4 depicts a vibrating particle material filled reclining device 66 as may be used to transfer vibration to a single user while the user is in a reclined position. Vibrating particle material filled reclining device 66 has a general form which has smooth contours which change during usage. Vibrating particle material filled reclining device 66 has a deployed orientation 68. While in deployed orientation 68 a seating surface 70, a back support surface 72 and a leg support surface 74 provide for at least partial support of the user while resting upon vibrating particle material filled reclining device 66 while the user's feet may be elevated above the floor. Back support surface 72 extends substantially above seating surface 70 while in deployed orientation 68. First vibration creation device 52 and second vibration creation device 54 cooperate to provide for vibration of vibrating particle material filled reclining device 66.

The embodiments depicted in FIG. 1 through FIG. 4 provide for convenient support of a single user while providing for elevated support of the user's torso. Alternatively, such seating or reclining devices may be configured to support multiple users while providing for the elevated support of the user's torso.

FIG. 5 depicts a vibrating particle material filled pillow 76 as may be conveniently used to contact a select portion of a user while transferring vibration to the user. Examples of such portions of the user include the head, neck, shoulders, various areas of the back, arms, legs and feet. Vibrating particle material filled pillow 76 has a general form which has smooth contours which change during usage to conform to the contacting portion of the user. Alternatively, applicable pillows may have a more structured configuration, as exampled by a pillow utilized for back support while resting in a conventional bed. Vibration creation device 36 provides for vibration of vibrating particle material filled pillow 76.

FIG. 6 depicts a vibrating particle material filled mattress 78 as may be used to transfer vibration to a single user while the user is in a prone position. Vibrating particle material filled mattress 78 has a general form which has smooth contours which change during usage. Vibration creation device 36 provide for vibration of vibrating particle material filled mattress 78.

Figure 7:
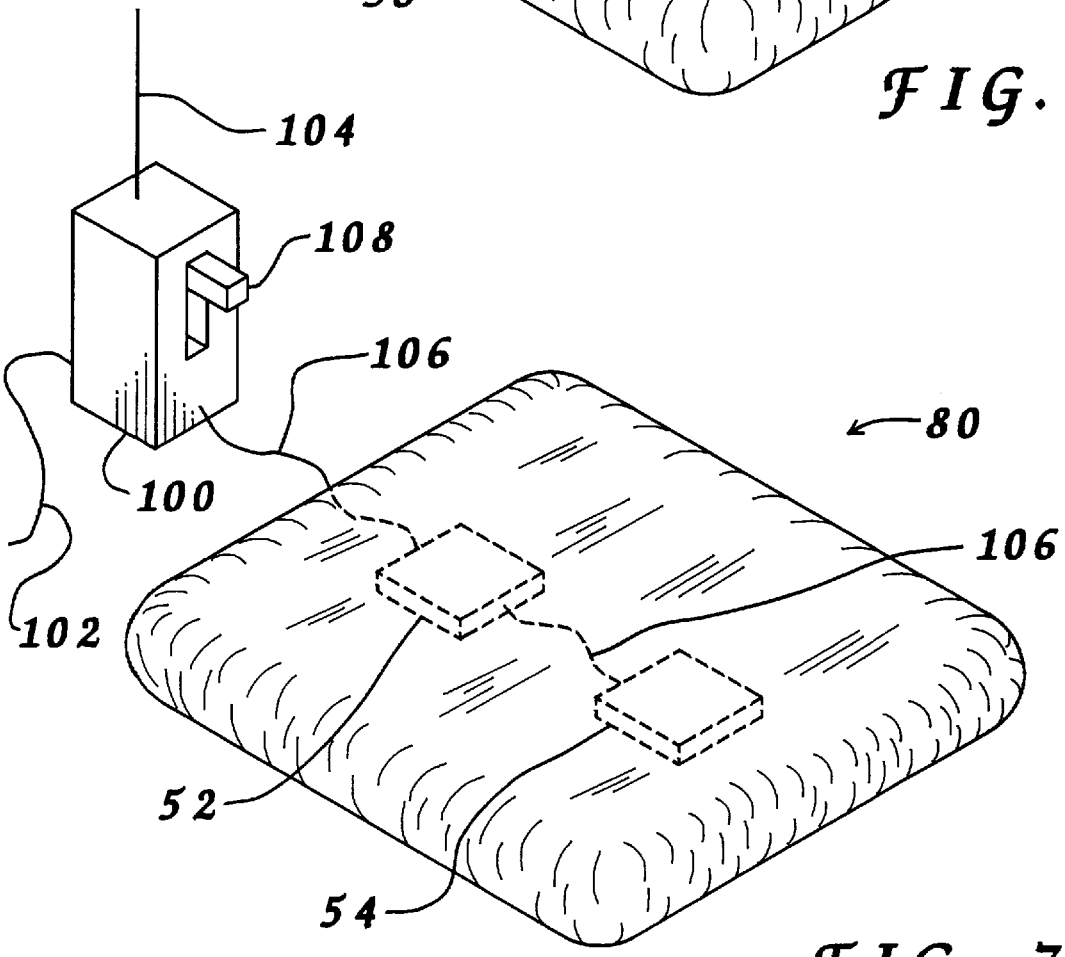
FIG. 7 is a perspective view of a second embodiment of a vibrating particle material filled mattress.

FIG. 7 depicts a vibrating particle material filled mattress 80 as may be used to transfer vibration to multiple users while the users are in a prone position. Vibrating particle material filled mattress 80 has a general form which has smooth contours which change during usage. First vibration creation device 52 and second vibration creation device 54 cooperate to provide for vibration of vibrating particle material filled mattress 80.

Vibrating particle material filled mattresses may be utilized within frames conventionally used to support existing mattresses or fluid filled mattresses, as exampled by water beds. Such utilization provides for ample support of the user while allowing for the many benefits of vibration.

Numerous types of material may be utilized as the particle material of the present invention. These include manufactured materials as well as various natural materials. A particularly expedient natural material is buck wheat which has various properties which make it an extremely desirable material.

The particle material may be solid, hollow or porous in composition. The material may have a symmetrical shape or may be irregularly shaped. Examples of symmetrically shapes include round and oval. Examples of irregular shapes include shredded foam rubber. The material may have a generally consistent size or may have individual pieces of various sizes. The material may be relatively rigid, deformable or may be somewhat compressible. The material may have a generally smooth surface which allows ready movement between adjacent pieces or may have a rough surface which provides for resistance to movement between adjacent pieces.

FIG. 8*a* through FIG. 10*b* depict examples of particle material in two dimensional configurations for illustrative purpose. In deployment, such configurations extend to a third dimension with possible movement of the particle material in all directions.

Figure 8A:
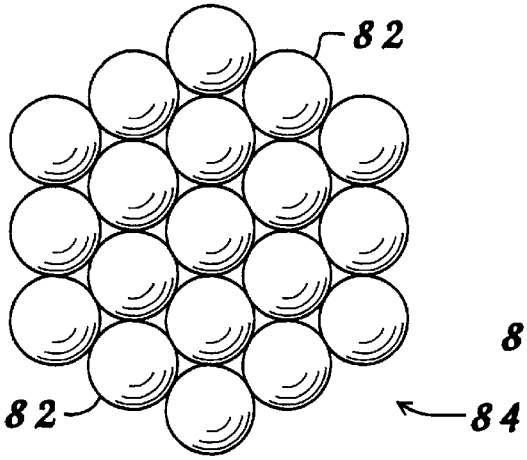
FIG. 8*a* and FIG. 8*b* are elevational views of a rigid particle material in various positional orientations.
Figure 8B:
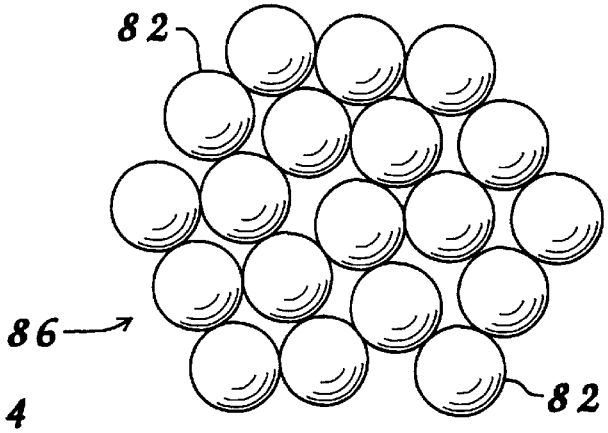

FIG. 8*a* and FIG. 8*b* depict a rigid particle material 82 in a static orientation 84 wherein there exists no external pressure thereupon and a compressed orientation 86 wherein there exists an external pressure applied thereupon. In this embodiment rigid particle material 82 are collectively displaced to absorb that pressure.

Figure 9A:
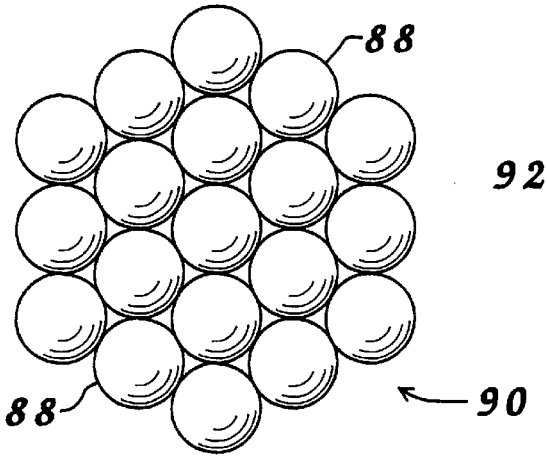
FIG. 9*a* and FIG. 9*b* are elevational views of a deformable particle material in various positional orientations.
Figure 9B:
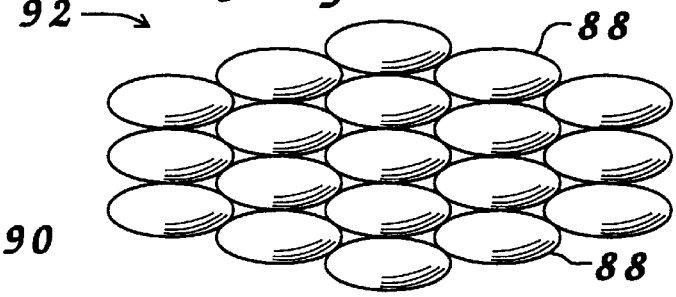

FIG. 9*a* and FIG. 9*b* depict a deformable particle material 88 in a static orientation 90 wherein there exists no external pressure thereupon and a compressed orientation 92 wherein there exists an external pressure applied thereupon. In this embodiment deformable particle material 88 are collectively deformed to absorb that pressure. Deformable particle material 88 may also be displaced as a result of that pressure.

Figure 10A:
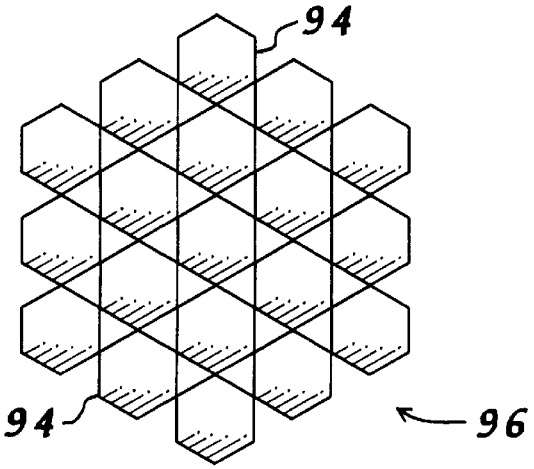
FIG. 10*a* and FIG. 10*b* are elevational views of a compressible particle material in various positional orientations.
Figure 10B:
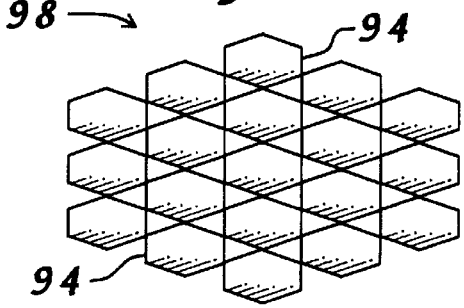

FIG. 10*a* and FIG. 10*b* depict a compressible particle material 94, having an irregular shape, in a static orientation 96 wherein there exists no external pressure thereupon and a compressed orientation 98 wherein there exists an external pressure applied thereupon. In this embodiment compressible particle material 94 are collectively compressed to absorb that pressure. Compressible particle material 94 may also be displaced as a result of that pressure.

Numerous methods may be employed to provide the desired vibration within the particle material, and therefore, within the overall vibrating particle material filled support furniture. The desired vibration may pulsate on a uniform cycling. Such vibration may further comprise a repetitive cycling of cycles of differing vibration intensities. Alternatively, the vibration may have a predetermined variation in the timing and intensity of cycles. A particularly desirable form of vibration may be obtained by providing for such cycles to be synchronized with a musical composition. This is particularly desirable when such vibration is utilized in combination with an audio production of the musical composition.

Numerous methods may be employed to transfer power to vibration creation devices applicable to the present invention. Such power transfer means are conventionally known in the art. FIG. 7 depicts a converter 100 having an input line 102, an antenna 104 and an output line 106. Input line 102 provides power to converter 100 while antenna 104 receives a broadcast signal as conventionally known. Converter 100 acts upon the received broadcast signal and produces an electronic signal which is transferred to first vibration creation device 52 and second vibration creation device 54 using output line 106. As conventionally known, converter 100 may receive a media which contains the musical composition, or other suitable composition, as exampled by a compact disk, and produce the electronic signal containing that composition. Means are provided in the preferred form of a switch 108 which controls converter 100. Additionally, a timing device may be employed which terminates vibration after a predetermined period of vibration. Similar control means may be used for any embodiment of vibration creation devices.

Figure 11A:
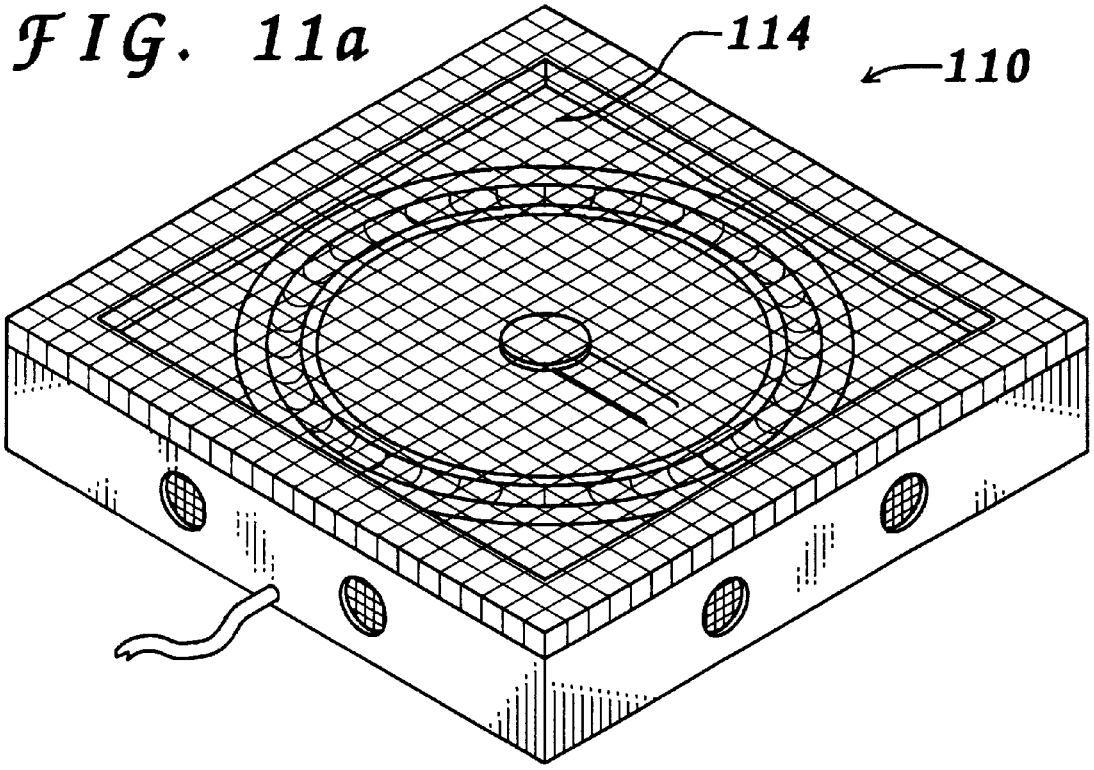
FIG. 11*a* and FIG. 11*b* are perspective views of a speaker assembly.
Figure 11B:
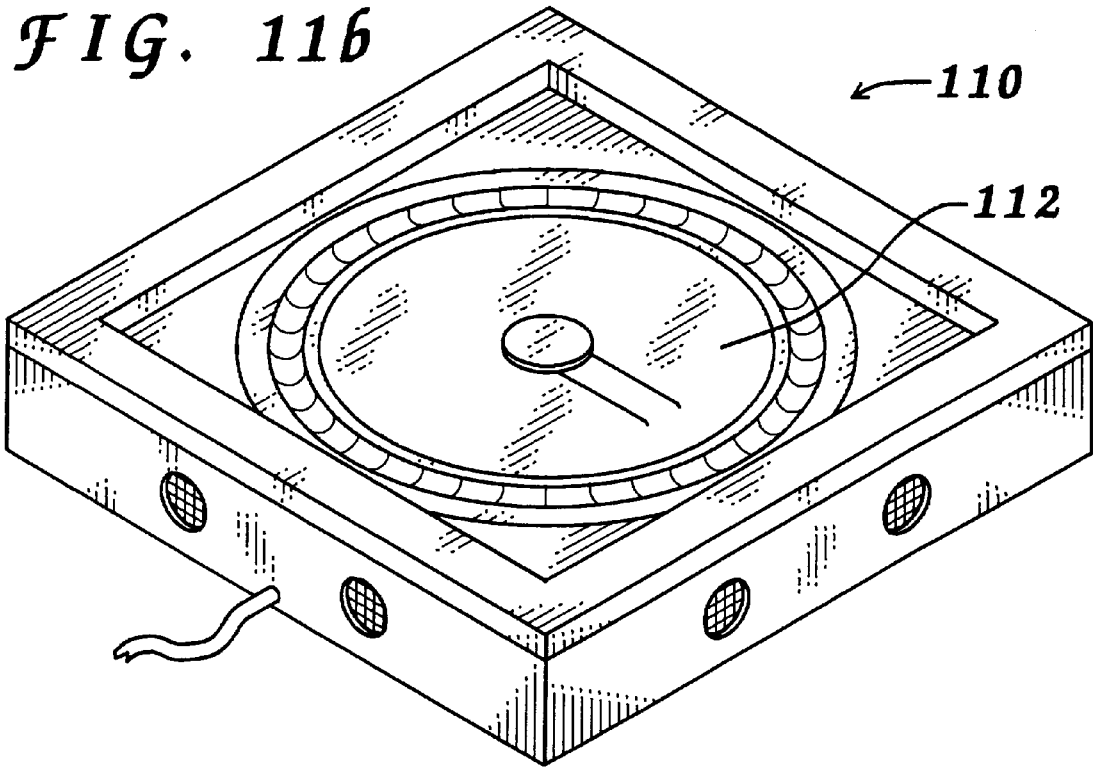

FIG. 11*a* and FIG. 11*b* depict a speaker assembly 110 capable of generating simultaneous vibration and audio reproduction of a musical composition. This provides for dual sensory enjoyment of the musical composition. An electronic signal containing the musical composition is produced by any conventionally known electronic equipment currently available and transferred to speaker assembly 110 by conventionally known means. As conventionally known in the art, a vibration membrane 112 is caused to vibrate as a result of electronic control over a magnetic field. When speaker assembly 110 is deployed in contact with the particle material it is desirable that the particle material be kept away from vibration membrane 112 of speaker assembly 110. This desire may be satisfied by numerous structures. One example of such a structure involves a resonate member 114, see FIG. 11*a*, which is stretched to be suspended above vibration membrane 112. (Resonate member 114 has been removed in FIG. 11*b*.) The deployed particle material would contact resonate member 114 and not be in contact with vibration membrane 112 of speaker assembly 110. It is possible to provide for the musical composition to be audibly produced by secondary, non vibration creation speakers, for an enhanced enjoyment of the user. Such secondary speakers may be mounted on the vibrating furniture piece or independently positioned thereabout.

Figure 12:
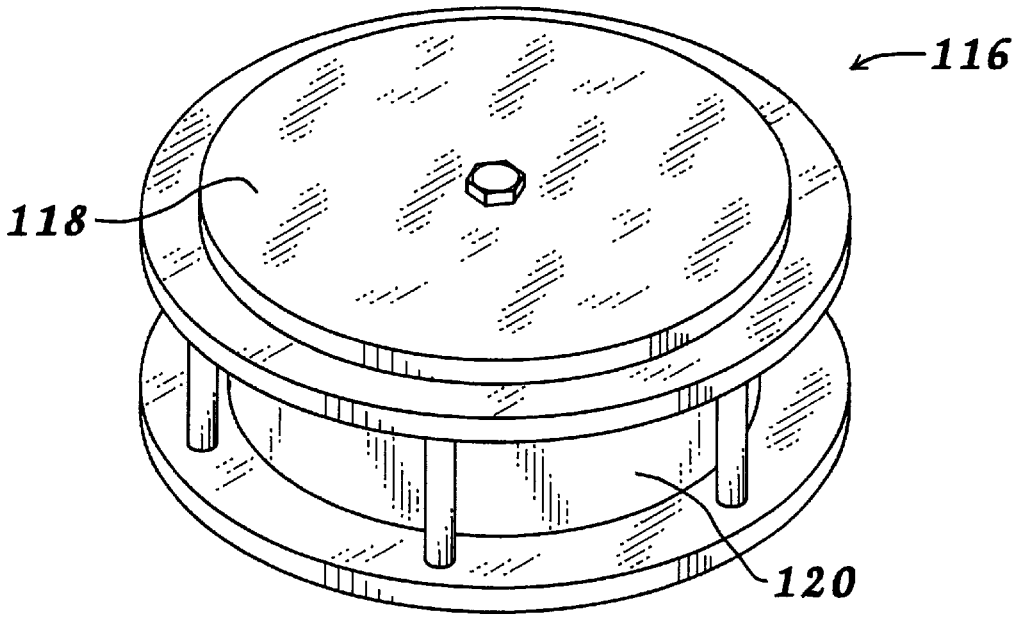
FIG. 12 is a perspective view of a transducer assembly.

FIG. 12 depicts a transducer assembly 116 which may be selectively employed to produce either the uniform vibration, variable cycling vibration or the vibration in synch with the musical composition. Such transducers are well known in the art. A vibration plate 118 rapidly pulsates upward and downward relative to a housing 120 as a result of electronic control over a magnetic field.

The art is rich with devices which provide for mechanical vibration wherein a power source powers a rapid oscillation of the device, or a portion thereof. Many of these devices may be utilized to provide the desired vibration of the present invention. These mechanical embodiments are independent of the structures identified broadly under the above descriptions of speakers and transducers which rely, at least in part, upon manipulation of a magnetic field to cause the desired vibration. Mechanical vibration is best exampled by a linear oscillation of one part relative to a base member. Other patterns, as exampled by circular or oval, may be employed during the oscillation of one part relative to the base member.

Figure 13A:
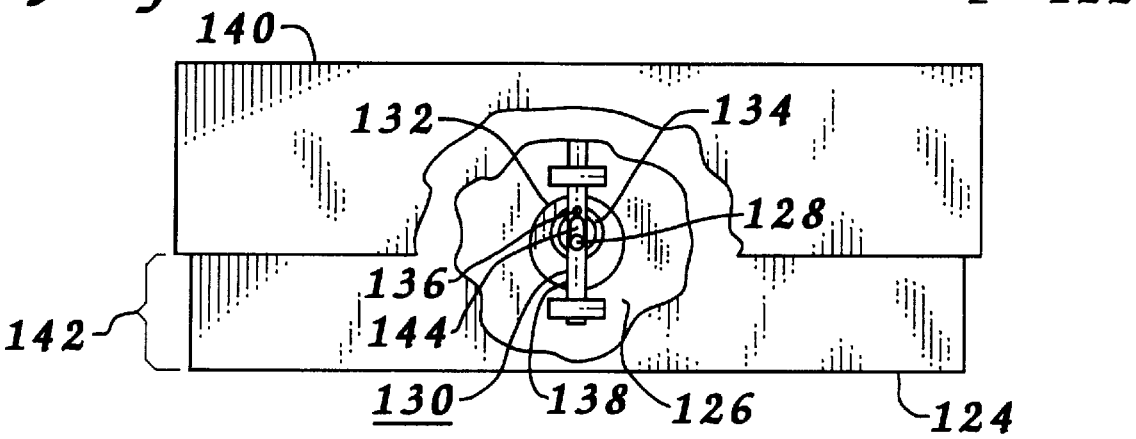
FIG. 13*a* and FIG. 13*b* are elevational views of a mechanical vibration creation device with sections cut away therefrom.
Figure 13B:
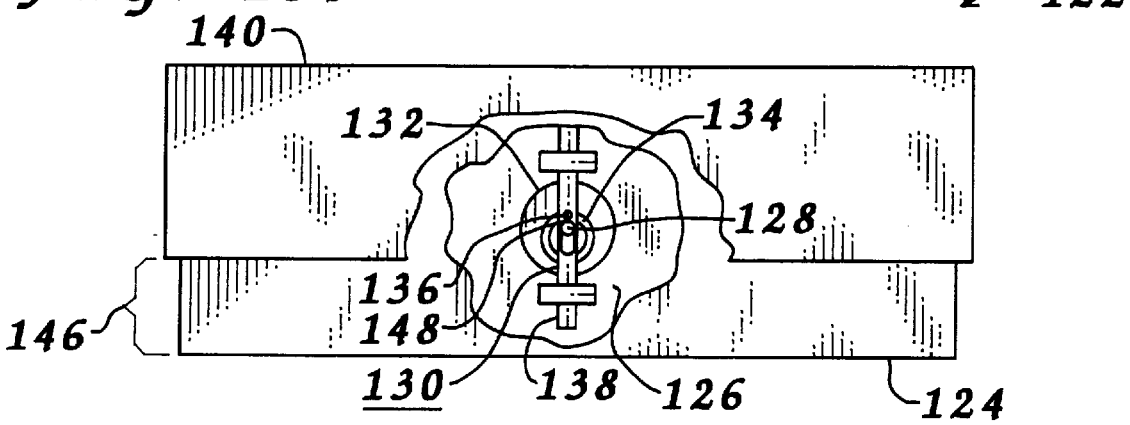

FIG. 13*a* and FIG. 13*b* depict a mechanical vibration creation device 122 having a base member 124 which houses a motor 126 which powers rotation of a shaft 128. Shaft 128 links to a drive member 130 having a wheel 132 which has thereon an eccentric track 134 which has mounted therein a coupling shaft 136. Coupling shaft 136 linearly moves inward and outward relative to shaft 128 during rotation of wheel 132. Coupling shaft 136 is rigidly attached to a linking rod 138 which in turns attaches to a cover plate 140. Therefore, cover plate 140 will linearly oscillate relative to base member 124 during operation of motor 126. FIG. 13*a* depicts cover plate 140 at an elevated position 142 relative to base member 124 while coupling shaft 136 is at a farthest spacing 144 from shaft 128. FIG. 13*b* depicts cover plate 140 at a lowered position 146 relative to base member 124 while coupling shaft 136 is at a closest approach 148 to shaft 128. Preferably, at least two (2) drive members 130 are contained within mechanical vibration creation device 122 in spaced orientation to operate in synch.

The embodiments depicted in the various views provide for the particle material to be contained completely within an enclosure at least partially formed of a supple material. Alternatively, it is possible to provide for the particle material to be loosely contained within an open container. An example of such a deployment involves a tub having an open top with a multiplicity of particle material pieces contained therein. This arrangement provides for a ball bath within the tub which encourages relaxation, builds confidence and strengthens sensorimotor skills.

Numerous usages of the open tub design exist. A first usage is exampled by a therapy device wherein particle material having a small diameter, as exampled by buck wheat, are deployed therein. A patient would then immerse them self, or a portion thereof, therein while the vibration creation device produces a therapeutic message upon the patient. A second usage is exampled by a children therapy/amusement device wherein particle material having a medium to large diameter, as exampled by plastic hollow balls of two (2) to three (3) inch diameter, are deployed therein. Children would then play therein while the vibration creation device produces an enjoyable rhythmic vibration upon the children. Such usage also encourages the children to move and experiment with their bodies including the big muscle activities for therapy and free play. The larger diameter balls are too large to be swallowed and may be molded in a variety of bright primary colors. Preferably, the walls of the tub are thick and padded, as exampled by being constructed of high resiliency foam and upholstered in heavy vinyl.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A vibrating particle material filled support device comprising:

a) a particle material filled support assembly comprising:
   1) a supple material;
   2) forming means for forming the supple material into an enclosure;
   3) a quantity of a loose particle material inserted into the enclosure to loosely fill the enclosure;
   4) sealing means for sealing the enclosure with the loose particle material enclosed therein wherein the enclosure with the loose particle material enclosed therein forms the particle material filled support assembly, the particle material filled support assembly having a deployed orientation while placed upon a floor;
   5) a seating surface elevated above the floor while in the deployed orientation;
   6) a back support surface extending substantially above the seating surface while in the deployed orientation, the back support surface adjacent the seating surface;
   7) a ground contacting surface for contact with the floor while in the deployed orientation, the ground contacting surface beneath the seating surface;

b) mechanical vibration means in contact with the particle material of the particle material filled support assembly for causing a vibration of the loose particle material within the enclosure, the vibration of the loose particle material causing an overall vibration of the particle material filled support assembly;

c) control means exercising control over the vibration means for a selective activation and a selective deactivation of the overall vibration of the particle material filled support assembly caused by the vibration of the loose particle material caused by the mechanical vibration means;

whereby the vibrating particle material filled support device is formed of the particle material filled support assembly, the mechanical vibration means and the control means.

2. The vibrating particle material filled seating device defined in claim 1 further comprising audio production means to provide for receiving an electronic signal and producing a audible reproduction therefrom of a musical composition to emanate from within the vibrating particle material filled seating device.

3. The vibrating particle material filled seating device defined in claim 1 wherein the vibration means further comprises a vibration generation device and wherein the vibration generation device is positioned in contact with the ground contacting surface while the particle material filled seating assembly is in the deployed orientation.

4. The vibrating particle material filled seating device defined in claim 1 wherein the vibration means further comprises a vibration generation device and wherein the vibration generation device is positioned adjacent to the back support surface and spaced above the floor while the particle material filled seating assembly is in the deployed orientation.

5. The vibrating particle material filled seating device defined in claim 1 wherein the loose material further comprises rigid particles.

6. The vibrating particle material filled seating device defined in claim 1 wherein the loose material further comprises compressible particles.

7. A method of providing for a dual sensory enjoyment for a person resting on a particle material filled support assembly, the dual sensory enjoyment comprising, a vibration of the particle material filled support assembly in tempo to a musical composition, and an audio reception of the musical composition emanating from the particle material filled support assembly, the method comprising the steps of:

a) providing a particle material filled support assembly comprising:
   1) a supple material;
   2) forming means for forming the supple material into an enclosure;
   3) a quantity of a loose particle material inserted into the enclosure to loosely fill the enclosure;
   4) sealing means for sealing the enclosure with the loose particle material enclosed therein wherein the enclosure with the loose particle material enclosed therein forms the particle material filled support assembly, wherein the loose particle material may move about within the enclosure in response to pressures applied upon the particle material filled support assembly, the particle material filled support assembly having a deployed orientation while placed upon a floor;
   5) a user support surface elevated above the floor while in the deployed orientation;
   6) a ground contacting surface for contact with the floor while in the deployed orientation, the ground contacting surface beneath the user support surface;

b) providing electronic receiving means for receiving an electronic signal transmitting the musical composition;

c) providing mechanical vibration means for receiving the electronic signal as received by the electronic receiving means and said mechanical vibration means in contact with the loose particle material and imparting a rhythmic vibration in tempo to the musical composition to the loose particle material contained within the particle material filled support assembly;

d) providing audio production means for receiving the electronic signal as received by the electronic receiving means and producing a audible reproduction therefrom of the musical composition to emanate from within the particle material filled support assembly.

8. The method defined in claim 7 wherein the vibration means further comprises a vibration generation device and wherein the vibration generation device is positioned in contact with the ground contacting surface while the particle material filled support assembly is in the deployed orientation.

9. The method defined in claim 7 wherein the vibration means further comprises a vibration generation device and wherein the vibration generation device is positioned within the particle material filled support assembly and spaced above the floor while the particle material filled support assembly is in the deployed orientation.

10. The method defined in claim 7 wherein the audio production means further comprises a speaker assembly and wherein the vibration means further comprises a resonate member, the resonate member in contact with the particle material and caused to resonate in response to sound waves produced by the speaker assembly.

* * * * *